US006298490B1

(12) United States Patent
Prouty

(10) Patent No.: US 6,298,490 B1
(45) Date of Patent: Oct. 9, 2001

(54) WORK GLOVE

(76) Inventor: Ronald L. Prouty, 239 NE. Graham, Portland, OR (US) 97212

( * ) Notice: Subject to any disclaimer, the term of this patent is extended or adjusted under 35 U.S.C. 154(b) by 0 days.

(21) Appl. No.: 09/780,692

(22) Filed: Feb. 9, 2001

(51) Int. Cl.[7] ..... A41D 19/02
(52) U.S. Cl. ..... 2/161.6; 2/169
(58) Field of Search ..... 2/161.6, 169

(56) References Cited

U.S. PATENT DOCUMENTS

| | | | | |
|---|---|---|---|---|
| Re. 13,524 | * | 2/1913 | Chaddock et al. . | |
| 709,595 | | 9/1902 | Carson . | |
| 964,608 | * | 7/1910 | Chaddock et al. . | |
| 996,287 | * | 6/1911 | Shimer et al. . | |
| 1,554,291 | | 9/1925 | Peck . | |
| 1,637,181 | * | 7/1927 | Gillian . | |
| 1,673,517 | | 6/1928 | Kurz . | |
| 1,765,282 | * | 6/1930 | McKinley . | |
| 1,984,183 | | 12/1934 | Gillespie | 2/159 |
| 2,617,109 | * | 11/1952 | Slimovitz . | |
| 2,742,645 | * | 4/1956 | Bleeth . | |
| 3,151,334 | * | 10/1964 | Haupt et al. . | |
| 4,779,289 | | 10/1988 | Prouty . | |

* cited by examiner

*Primary Examiner*—Rodney M. Lindsey
(74) *Attorney, Agent, or Firm*—James D. Givnan, Jr.

(57) ABSTRACT

A work glove having internal stitching joining a palm piece to a finger piece having three finger stalls. A fourth finger stall is integral with the palm piece as is an inner thumb member. An outer thumb member extends the along the side of the glove and is attached to a pair of thumb inserts attached to the palm piece. All stitching of the glove is concealed from the glove exterior and hence from contact with a workpiece.

1 Claim, 2 Drawing Sheets

20
26
1
5
20
21
22
5
14
3
13
3
18
12

16
24
4
4
19
5
5
26
1
4
5
14
13
18
1
25
17
12
19

14
18
13

17
19
12
19
16

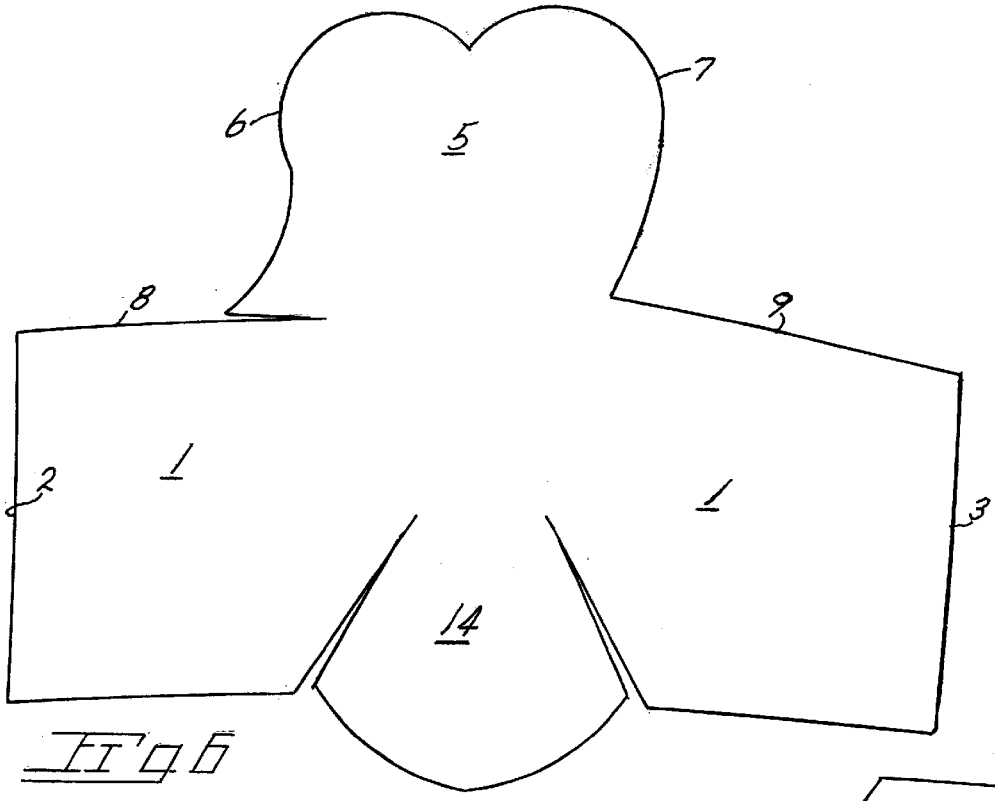
FIG 6
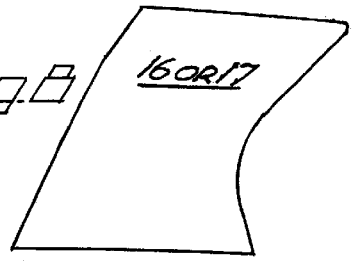
FIG 8
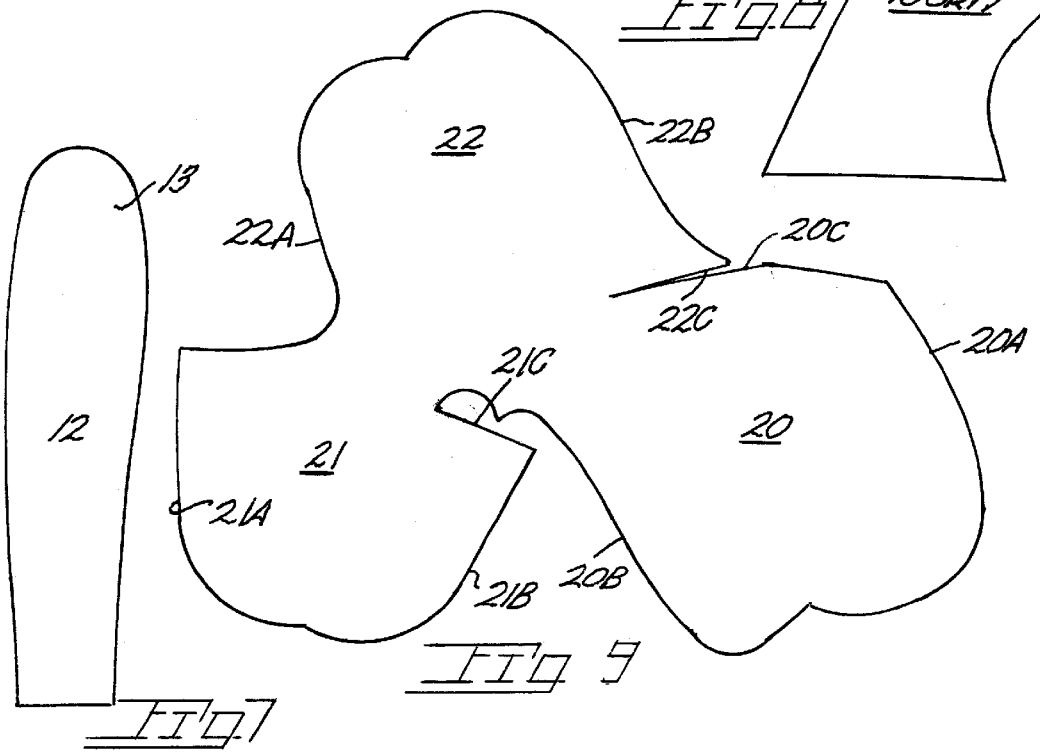
FIG 9
FIG 7

WORK GLOVE

BACKGROUND OF THE INVENTION

The present invention pertains generally to gloves, and particularly to work gloves worn by workers handling heavy articles such as steel plate, plywood, sawn lumber, etc.

Gloves worn by workers handling such products are subjected to extreme wear to the extent it is not uncommon to wear out a pair of gloves in a week or so. Glove wear can be extended by making a glove suitable for use on either hand so as to increase the number of areas subjected to such wear simply by inverting and switching the glove from one hand to the other. Such a glove is shown in U.S. Pat. No. 4,779,289, issued to the present inventor and has an insert defining the thumb-index finger crotch area with the insert having a perimeter overlain by a perimeter of an opening in the glove body.

In the prior art, U.S. Pat. Nos. 1,984,183; 1,554,291; 1,673,517 and 3,739,400 show two sided work gloves for wear on either hand.

SUMMARY OF THE PRESENT INVENTION

The present invention is embodied in a glove for wear on either hand and particularly suited for the handling of heavy articles yet being very flexible.

The present glove comprises five pieces facilitating economical cutting and assembly of the pieces with a palm component including a thumb member and a first finger stall while a finger piece includes the remaining finger stalls. A pair of thumb inserts and an outside member of the thumb complete the components of the glove.

Important objectives of the present glove is the provision of a glove of a highly flexible nature to provide a glove comfortable to wear throughout a work day. A further objective of the present glove is the prevention of glove damage and shortened glove life by utilizing concealed stitching. Such stitching avoids the risk of the glove snagging on a work piece.

BRIEF DESCRIPTION OF THE DRAWINGS

In the accompanying drawings:

FIGS. 6 though 9 are plan views of glove pieces.

DETAILED DESCRIPTION OF THE PREFERRED EMBODIMENTS

Figures 1, 2, 3, 4, 5:
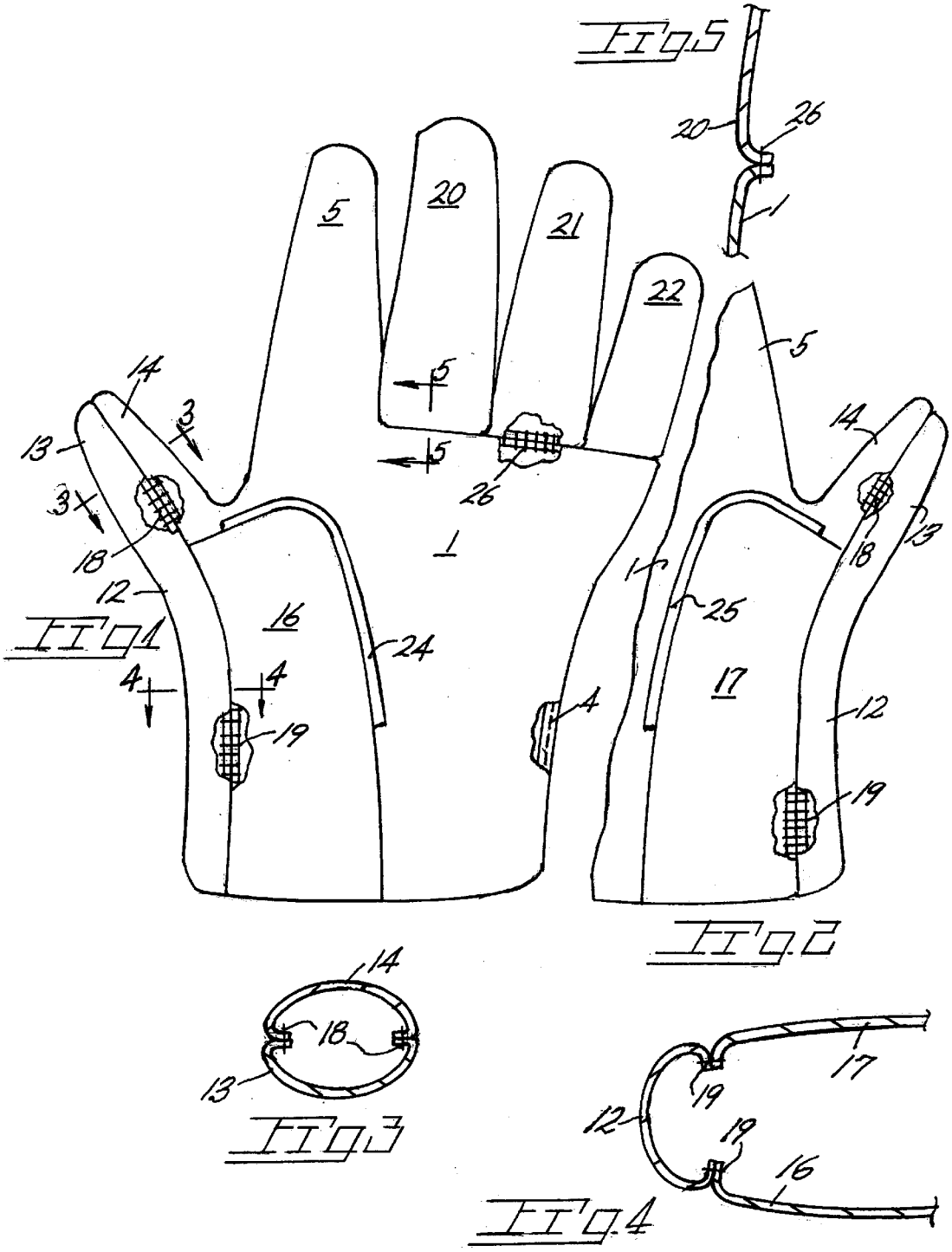
FIG. 1 is an elevational view of the present invention embodied in a work glove with the unseen side of the glove being a mirror image.
FIG. 2 is a fragmentary elevational view of the unseen side of the glove shown in FIG. 1.
FIG. 3 is a sectional view taken along line 3—3 of FIG. 1.
FIG. 4 is a sectional view taken along line 4—4 of FIG. 1.
FIG. 5 is a sectional view taken along line 5—5 of FIG. 1.

With continuing attention to the drawings wherein applied reference numerals indicate parts similarly hereinafter identified, the reference numeral 1 indicates the palm piece of the glove having edges 2 and 3 stitched together at 4 during sewing of the glove when turned inside out The index or the first of four glove fingers is at 5 with stitchable edges 6 and 7 (FIG. 6). Edges 8 and 9 of the palm piece receive a later described finger piece.

An outer thumb piece 12 (FIGS. 1 and 7) of the glove extends from the glove lower edge with a portion 13 of the outer thumb piece forming part of a thumb stall along with an inner thumb piece 14 on palm piece 1.

A pair of thumb inserts at 16 and 17 are on opposite sides of the glove. Stitching 18 and 19 respectively join thumb piece 12 to inner thumb piece 14 and to thumb inserts at 16–17.

In a preferred embodiment of the glove, finger stalls at 20, 21 and 22 are formed by concealed stitching of edges 20A–20B; 21A–21B and 22A–22B together respectively. Edges 20C; 21C and 22C are thereafter stitched to palm piece 1 along edges 8 and 9 by internal stitching as at 26. A modified form of the glove would provide finger stall 22 being integral with palm piece 1.

The foregoing description is applicable to the unseen side of the present glove which, as aforesaid, is a mirror image of FIG. 1. Wear strips 24 and 25 are stitched in place during glove assembly to further protect the stitched seams, The glove is assembled and sewn inside-out and then reversed for use. As the glove is symmetrical in construction on its two sides it may be worn on either hand contributing to glove life. Also the glove exterior is free of stitching to enhance durability.

While I have shown but one embodiment of the invention, it will be apparent to those skilled in the art that the invention may be embodied still otherwise without departing from the spirit and scope of the claimed invention.

Having thus described the invention, what is desired to be secured by a Letters Patent is:

1. A glove including, a palm piece including a first finger stall and an inner thumb piece an outer thumb piece stitched to said inner thumb piece;

thumb inserts stitched to said outer thumb piece and to said palm piece;

a second, third and fourth finger piece having edges stitched together forming finger stalls and at lease some having additional edges for stitched attachment to said palm piece; and stitching being entirely concealed from the glove exterior.

* * * * *